US011565897B2

(12) United States Patent
Maeda et al.

(10) Patent No.: US 11,565,897 B2
(45) Date of Patent: Jan. 31, 2023

(54) SHEET FEEDER AND IMAGE FORMING APPARATUS

(71) Applicant: FUJIFILM Business Innovation Corp., Tokyo (JP)

(72) Inventors: Shoichi Maeda, Kanagawa (JP); Masahito Niwa, Kanagawa (JP); Yuichi Araki, Kanagawa (JP); Yoshiki Kimura, Kanagawa (JP); Misaki Suruga, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 95 days.

(21) Appl. No.: 17/167,036

(22) Filed: Feb. 3, 2021

(65) Prior Publication Data

US 2022/0063937 A1 Mar. 3, 2022

(30) Foreign Application Priority Data

Aug. 28, 2020 (JP) ..... JP2020-145005

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2402/442* (2013.01); *B65H 2405/115* (2013.01); *B65H 2405/121* (2013.01); *B65H 2405/332* (2013.01); *B65H 2407/21* (2013.01); *B65H 2511/11* (2013.01)

(58) Field of Classification Search
CPC . B65H 1/04; B65H 1/26; B65H 11/00; B65H 2405/115; B65H 2405/12; B65H 2405/121; B65H 2405/332; B65H 2511/11; B65H 2402/31; B65H 2402/44; B65H 2402/441; B65H 2402/442; B65H 2402/45; B65H 2407/21
See application file for complete search history.

(56) References Cited

U.S. PATENT DOCUMENTS

| | | | | |
|---|---|---|---|---|
| 8,991,811 | B1 * | 3/2015 | Iijima | B65H 1/04 271/162 |
| 9,359,157 | B2 | 6/2016 | Niikura et al. | |
| 2016/0332828 | A1 * | 11/2016 | Wakakusa | B65H 5/26 |
| 2020/0282751 | A1 * | 9/2020 | Suruga | B41J 13/103 |
| 2021/0101765 | A1 * | 4/2021 | Morisawa | B65H 1/04 |

FOREIGN PATENT DOCUMENTS

JP 2016000653 1/2016

* cited by examiner

*Primary Examiner* — Prasad V Gokhale
(74) *Attorney, Agent, or Firm* — JCIPRNET

(57) ABSTRACT

A sheet feeder including: a housing including a mount portion that receives recording media; an open-close portion that is disposed on an upper surface of the housing to close the mount portion and rotates about a first hinge to open or close a mount space over the mount portion; and a manual insertion portion at least part of which is disposed on the open-close portion to receive manually inserted recording media, the manual insertion portion being rotatable about the first hinge or a second hinge disposed parallel to the first hinge to rotate upward from a position where the manual insertion portion overlaps the open-close portion.

20 Claims, 9 Drawing Sheets

SHEET FEEDER AND IMAGE FORMING APPARATUS

CROSS-REFERENCE TO RELATED APPLICATIONS

This application is based on and claims priority under 35 USC 119 from Japanese Patent Application No. 2020-145005 filed Aug. 28, 2020.

BACKGROUND

(i) Technical Field

The present disclosure relates to a sheet feeder and an image forming apparatus.

(ii) Related Art

Japanese Unexamined Patent Application Publication No. 2016-000653 discloses a sheet feeder that includes a housing, a feed tray including a mount plate that receives sheets and that is slidably attached to the inside and outside of the housing, a transport device that transports sheets stacked on the mount plate in a direction orthogonal to both a sliding direction of the feed tray and a sheet-stack direction, and an elongation option removably attached to the upstream side of the mount plate in the transportation direction and including an extension plate serving as an extension of the mount plate to receive a long-size sheet. The sheet feeder includes a first locking device that is capable of holding the feed tray in a first locking position where the feed tray is not slidable in response to attachment of the elongation option thereto, and that is capable of holding the feed tray in a first unlocking position where the feed tray is slidable in response to detachment of the elongation option therefrom.

For example, a sheet feeding module having an openable/closeable upper surface may allow a manual tray to be mounted thereon. When the sheet feeding module has an open-close portion at such a position as to avoid the manual tray, the open-close portion is opened and closed within a limited range, and hinders removal or insertion of recording media.

SUMMARY

Aspects of non-limiting embodiments of the present disclosure relate to a sheet feeder having an openable/closeable upper surface and including a housing that includes a manual insertion portion. The sheet feeder includes an open-close portion that is opened and closed within a larger range than an open-close portion disposed at such a position as to avoid the manual tray.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a sheet feeder including a housing including a mount portion that receives recording media, an open-close portion that is disposed on an upper surface of the housing to close the mount portion and rotates about a first hinge to open or close a mount space over the mount portion, and a manual insertion portion at least part of which is disposed on the open-close portion to receive manually inserted recording media, the manual insertion portion being rotatable about the first hinge or a second hinge disposed parallel to the first hinge to rotate upward from a position where the manual insertion portion overlaps the open-close portion.

BRIEF DESCRIPTION OF THE DRAWINGS

Exemplary embodiments of the present disclosure will be described in detail based on the following figures, wherein.

DETAILED DESCRIPTION

Figure 1:
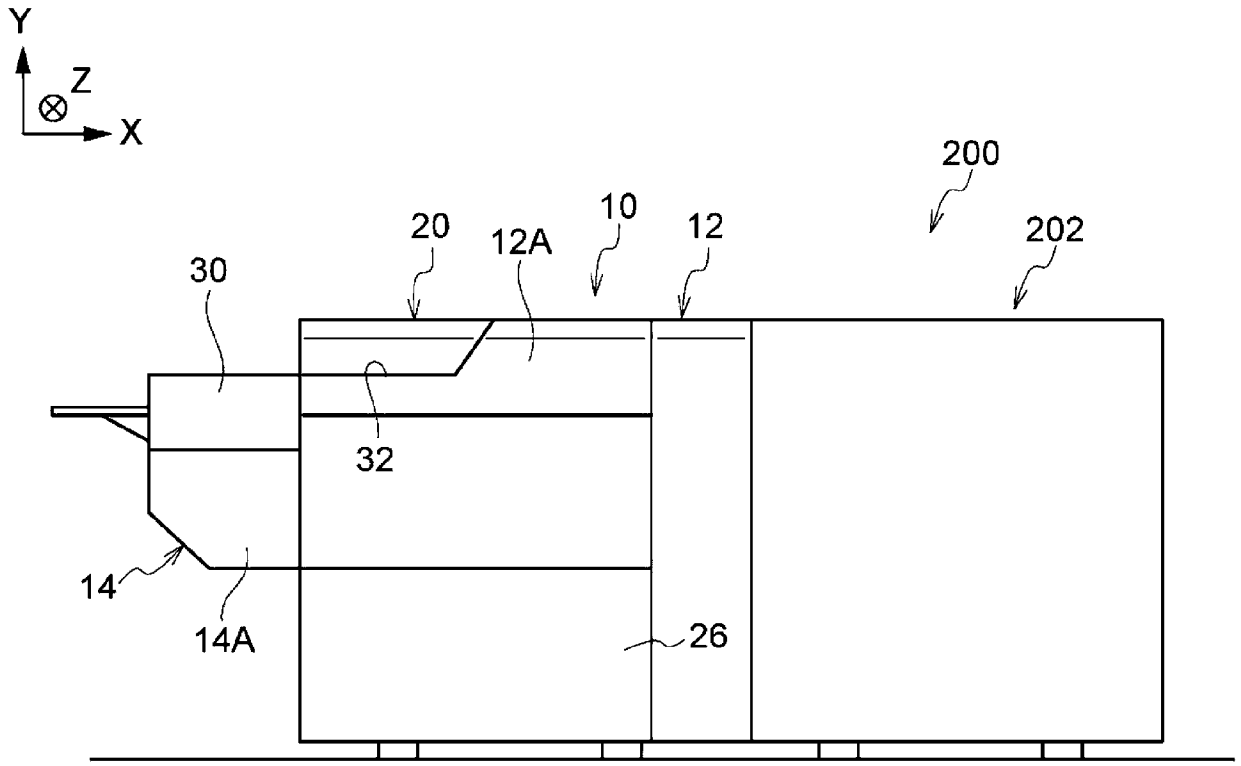
FIG. 1 is a front view of an image forming apparatus including a sheet feeder according to a first exemplary embodiment.

Embodiments of the technology of the present disclosure will be described below. In the following description, in the drawings illustrated as appropriate, the direction indicated with arrow X is defined as an apparatus width direction and the direction indicated with arrow Y is defined as an apparatus height direction. The direction (direction of arrow Z) orthogonal to the apparatus width direction and the apparatus height direction is defined as an apparatus depth direction.

First Exemplary Embodiment

Structure of Image Forming Apparatus

FIG. 1 is a front view of an example of an image forming apparatus 200 including a sheet feeder 10 according to a first exemplary embodiment.

As illustrated in FIG. 1, the image forming apparatus 200 includes the image forming apparatus body 202, which forms images on recording media to serve as an example of an image forming unit, and a sheet feeder 10, which feeds recording media to the image forming apparatus body 202. The sheet feeder 10 is disposed beside the image forming apparatus body 202. Although not illustrated, the image forming apparatus 200 includes, inside the image forming apparatus body 202, an image forming device that forms images on recording media and a transportation device that transports recording media to the image forming device. The structures and the layout of the image forming device and the transportation device are not limited to particular ones. The sheet feeder 10 is optionally attached to the image forming apparatus body 202, and tradable alone in the market.

Structure of Sheet Feeder

Entire Structure

Figure 2:
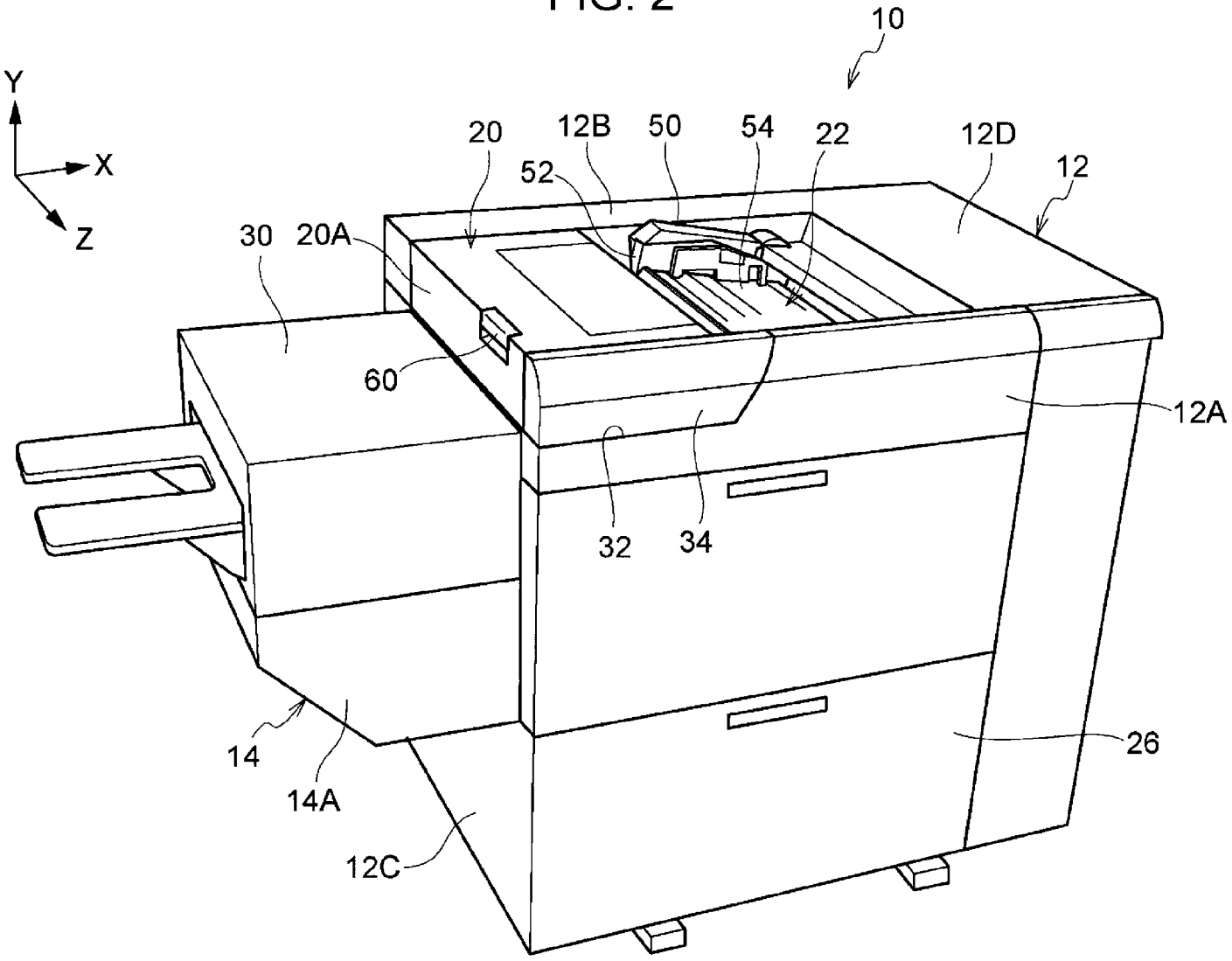
FIG. 2 is a perspective view of the sheet feeder according to the first exemplary embodiment.

FIG. 2 is a perspective view of the sheet feeder 10 according to the first exemplary embodiment. As illustrated in FIG. 2, the sheet feeder 10 includes a body 12, serving as an example of a housing, and a container device 14, protruding outward from the side of the body 12. The sheet feeder 10 includes, inside the container device 14, a mount portion 16 that receives multiple recording media P (refer to FIG. 3). The container device 14 is an example of a containing member removably attached to the body 12. The container device 14 is optionally retrofitted to the sheet feeder 10.

Figure 3:
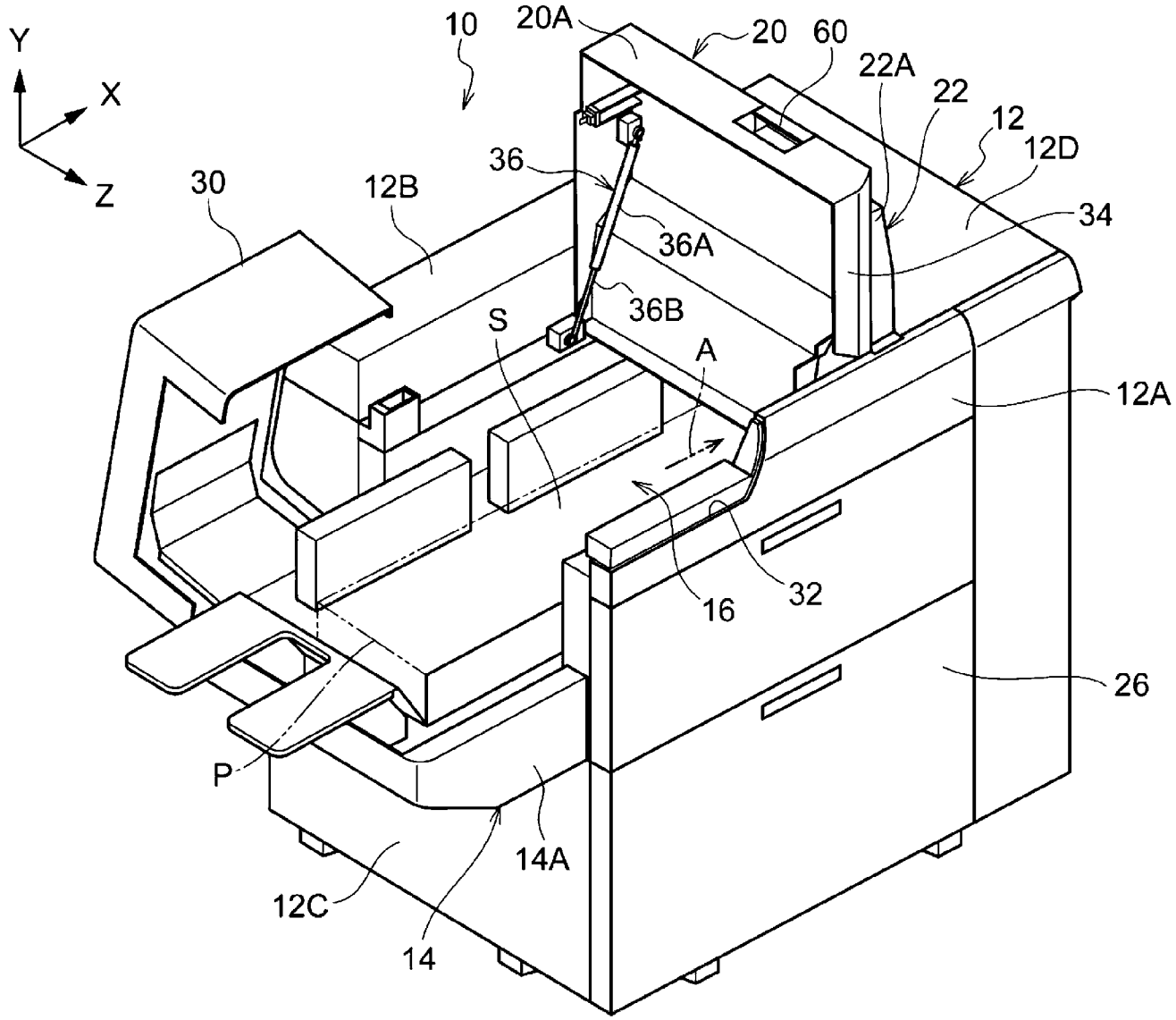
FIG. 3 is a perspective view of an open-close member and a rotation member included in the sheet feeder according to the first exemplary embodiment rotated to open a mount space over a mount portion.

As illustrated in FIGS. 2 and 3, the sheet feeder 10 includes an open-close member 20 located on the upper surface of the body 12 to close the upper side of the mount portion 16. The open-close member 20 is an example of an open-close portion. The open-close member 20 opens or closes a mount space S in the body 12 over the mount portion 16. The sheet feeder 10 includes a damper 36, which assists the operation of the open-close member 20 opening the mount space S (refer to FIG. 3). The sheet feeder 10 includes a rotation member 22, which is rotatable and at least part of which overlaps the open-close member 20. The rotation member 22 is an example of a manual insertion portion capable of receiving manually inserted recording media. At a portion of the container device 14 protruding from the side of the body 12, an open-close covering 30 that opens or closes the mount space S over the mount portion 16 is disposed. The open-close covering 30 will be described, below.

The sheet feeder 10 also includes a drawable tray 26 at a lower portion of the body 12 on the front side in the depth direction (that is, Z direction). The drawable tray 26 accommodates a recording medium (not illustrated) different from recording media P. The drawable tray 26 is drawn out from the body 12 to accommodate the recording medium (not illustrated) different from the recording media P.

Structure of Body 12

As illustrated in FIGS. 2 and 3, the body 12 serves as a housing including an outer wall of the sheet feeder 10. The body 12 includes a front wall 12A disposed at the front in the apparatus depth direction (that is, the Z direction), and a rear wall 12B disposed at the rear in the apparatus depth direction. The body 12 includes a side wall 12C disposed on a first side in the apparatus width direction (that is, X direction), and a side wall (not illustrated in FIG. 2) disposed on a second side in the apparatus width direction. The front wall 12A includes multiple panels. Here, the front wall 12A and the rear wall 12B are an example of a pair of walls. The front wall 12A is an example of a first wall. The drawable tray 26 is disposed over the range excluding the upper portion of the front wall 12A and the second side of the front wall 12A in the apparatus width direction.

The body 12 also includes an upper wall 12D, disposed above the front wall 12A, the rear wall 12B, the side wall 12C, and another side wall (not illustrated in FIG. 2). The upper wall 12D is disposed only on the second side in the apparatus width direction. The front wall 12A and the rear wall 12B are connected to the upper wall 12D at the upper ends, and part of the mount space S is covered with the upper wall 12D.

The front wall 12A and the rear wall 12B hold the mount space S over the mount portion 16 therebetween from both sides in the direction crossing the transportation direction of the recording media P, that is, in the apparatus depth direction indicated with arrow Z. The front wall 12A includes a cut portion 32 at a portion opposite to a portion near the upper wall 12D and having a lower height than a portion connected to the upper wall 12D. In other words, the cut portion 32 lowers the height of the portion on the upstream side in the transportation direction (that is, in the direction of arrow A illustrated in FIG. 3) of the recording media P stacked on the mount portion 16 compared to the height of the portion on the downstream side in the transportation direction of the recording media P. The transportation direction will be described below.

Structure of Container Device 14

The container device 14 has a function of accommodating multiple recording media P. As illustrated in FIGS. 2 and 3, the container device 14 protrudes outward from the upper portion of the side wall 12C of the body 12. The container device 14 extends from a position between the front wall 12A and the rear wall 12B and a position on the outer side of the side wall 12C. Specifically, the container device 14 is removably attached to a portion between the front wall 12A and the rear wall 12B of the body 12 and above the side wall 12C. The container device 14 includes a body 14A and the open-close covering 30 disposed over the body 14A.

Inside the container device 14, the mount portion 16 that receives the multiple recording media P are disposed (refer to FIG. 3). In the present exemplary embodiment, the recording media P stacked on the mount portion 16 are recording media longer than the length of an A3-size recording medium in the longitudinal direction. For example, the length of the recording media P in the longitudinal direction is 900 mm or 1200 mm.

In the sheet feeder 10, a sheet feeding device (not illustrated) disposed inside the body 12 near the upper wall 12D transports the recording media P stacked on the mount portion 16 one by one in the direction of arrow A. The mount portion 16 protrudes upstream in the transportation direction of the recording media P (that is, in direction of arrow A) from a position between the front wall 12A and the rear wall 12B. Specifically, in the sheet feeder 10, an upper portion of the side wall 12C between the front wall 12A and the rear wall 12B is open toward the upstream side in the transportation direction of the recording media P, and the mount portion 16 is disposed across the open portion.

The open-close covering 30 is rotated in the apparatus depth direction (refer to FIG. 3) with a hinge (not illustrated) disposed on the far side in the apparatus depth direction (that is, Z direction) of the body 14A. When the open-close covering 30 is rotated upward from the near side to the far side in the apparatus depth direction (Z direction), part of the mount space S over the mount portion 16 is opened.

Structure of Open-Close Member 20

The open-close member 20 has a function of opening the mount space S over the mount portion 16 while sharing the covering area with the open-close covering 30, to allow the multiple recording media P to be placed on the mount portion 16. As illustrated in FIGS. 2 and 3, the open-close member 20 is disposed between upper portions of the front wall 12A and the rear wall 12B. In the present exemplary embodiment, the open-close member 20 is disposed adjacent to the upper wall 12D of the body 12. The open-close member 20 is disposed on the upper surface of the body 12 in the state where the mount space S over the mount portion 16 is closed.

Figure 4:
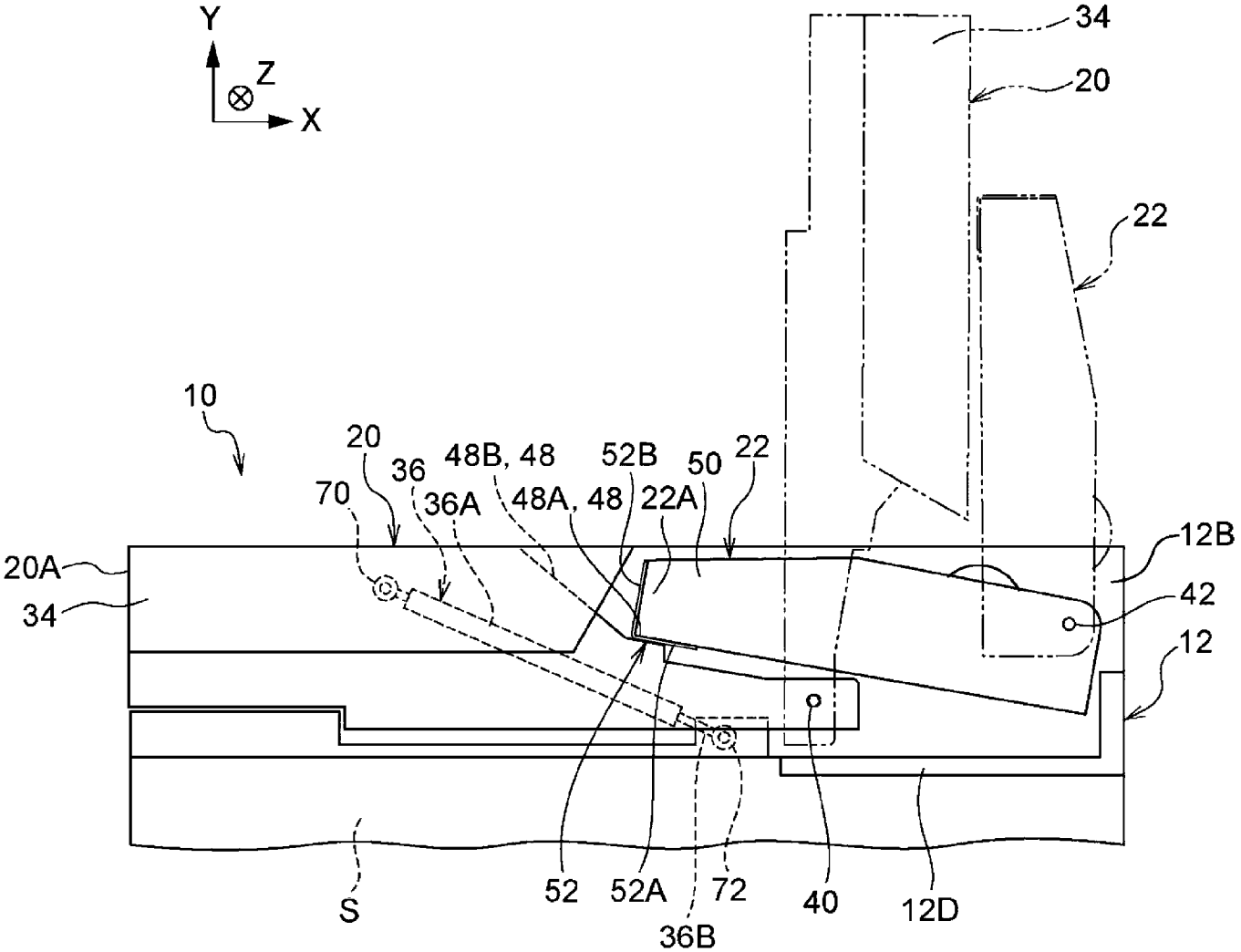
FIG. 4 is a vertical-sectional view of an upper portion of the sheet feeder according to the first exemplary embodiment where the open-close member and the rotation member are closed.
Figure 5:
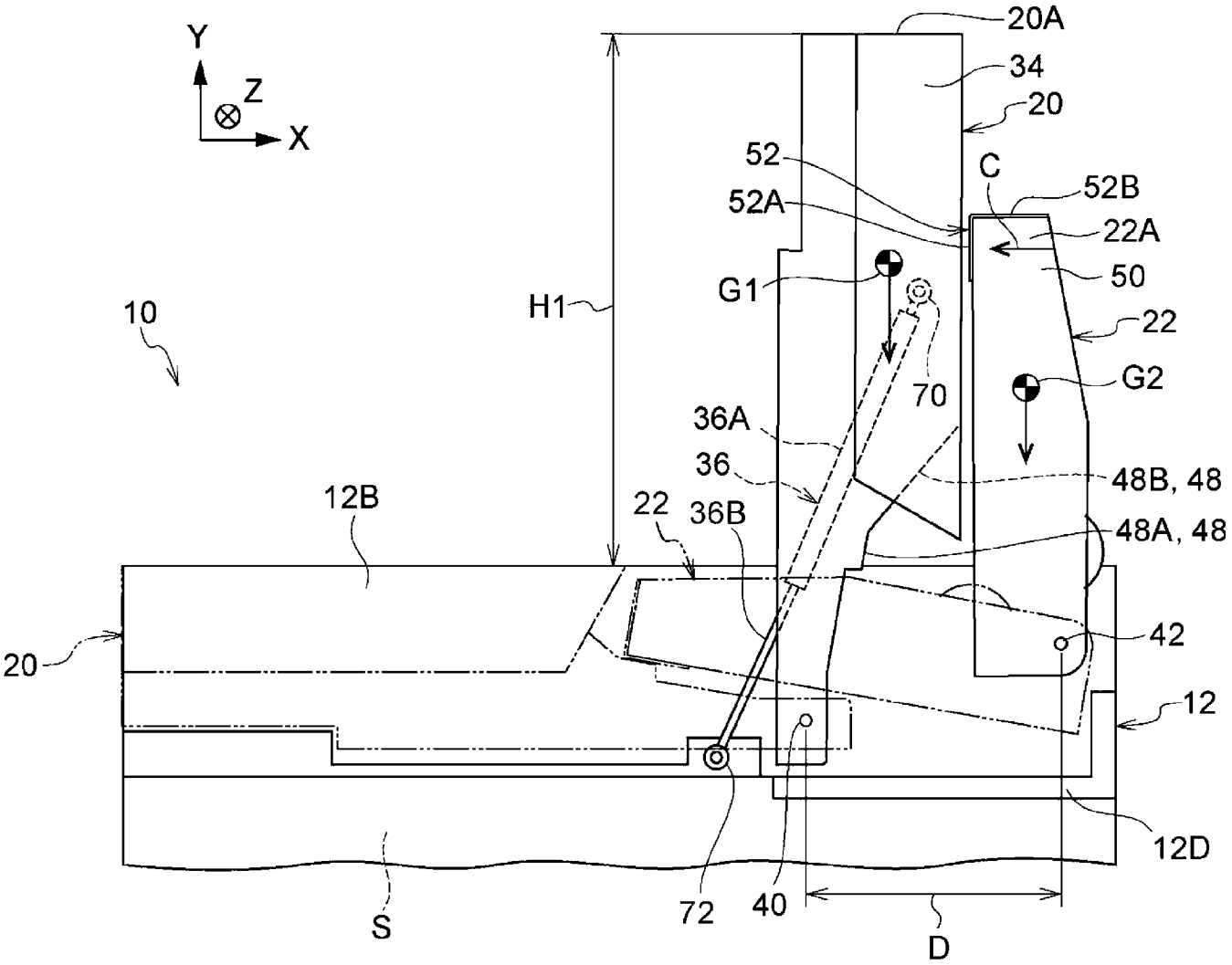
FIG. 5 is a vertical-sectional view of the upper portion of the sheet feeder according to the first exemplary embodiment where the open-close member and the rotation member are opened.
Figure 6:
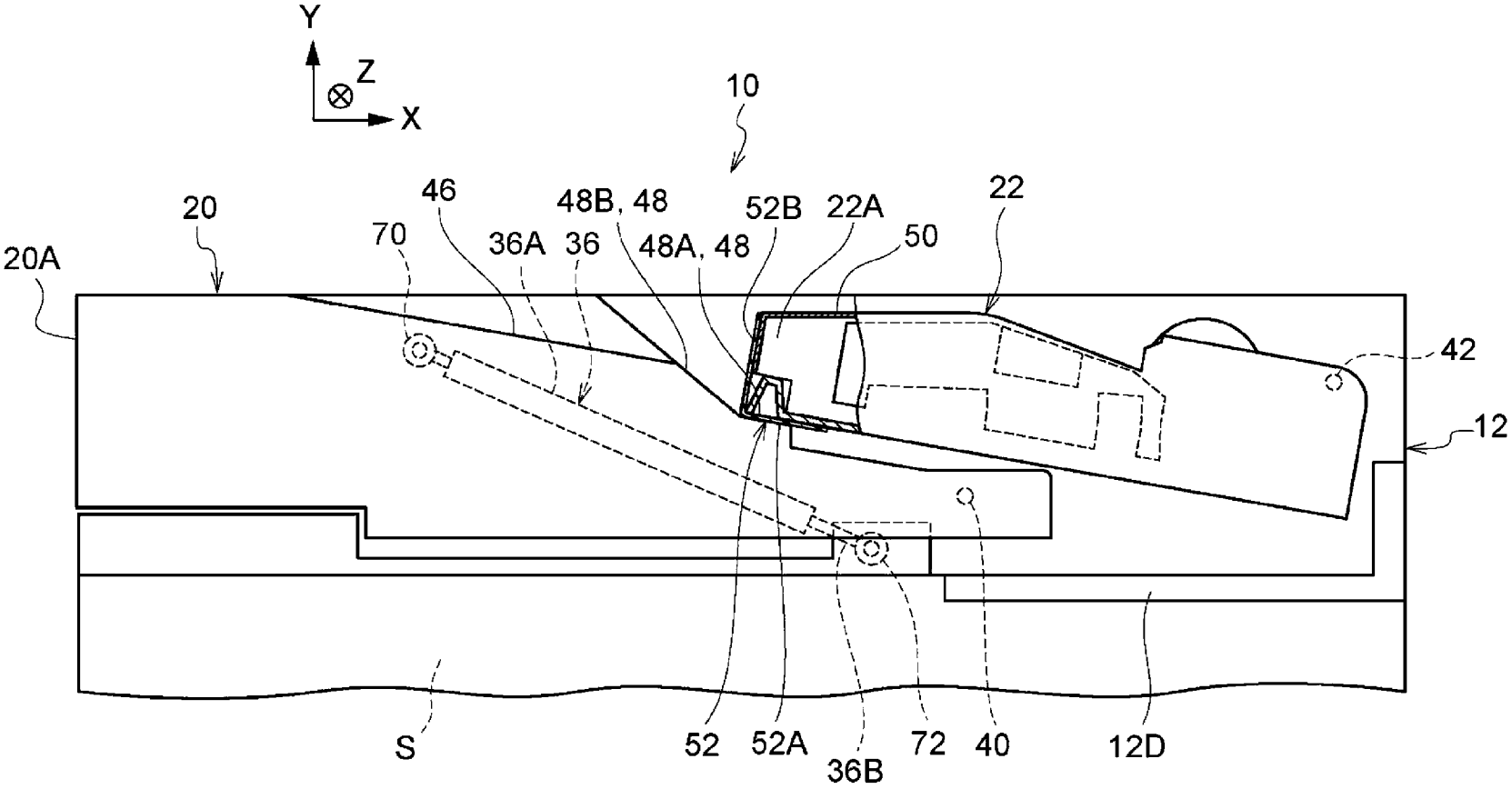
FIG. 6 is a partially sectional, front view of the upper portion of the sheet feeder according to the first exemplary embodiment where the open-close member and the rotation member close the mount space over the mount portion.
Figure 7:
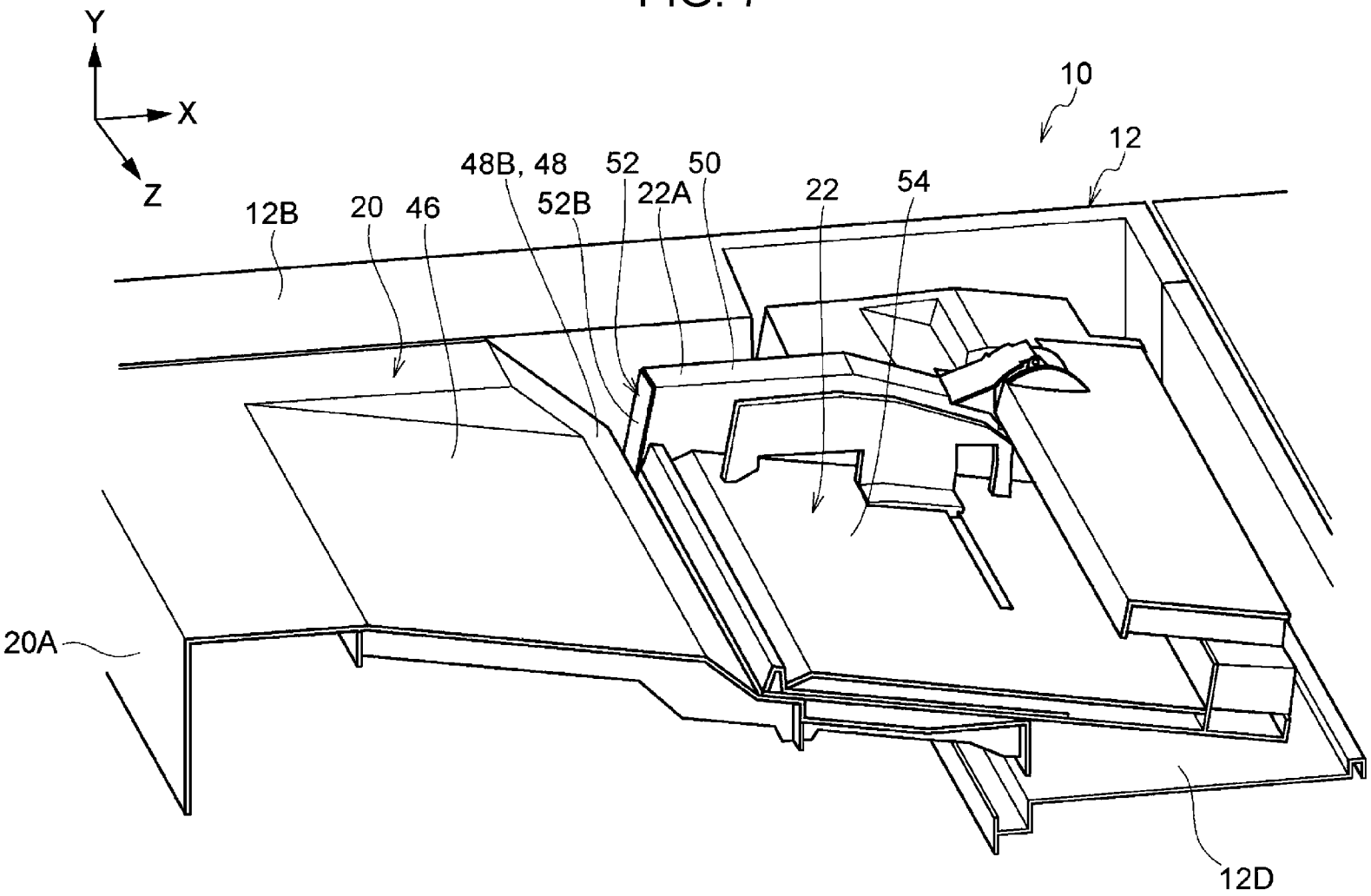
FIG. 7 is a perspective view of the upper portion of the sheet feeder according to the first exemplary embodiment where the open-close member and the rotation member close the mount space over the mount portion.

As illustrated in FIGS. 4 and 5, the open-close member 20 rotate about a first hinge 40, disposed at a first end portion in the transportation direction of the recording media P (that is, in the direction of arrow A illustrated in FIG. 3) to open or close the mount space S over the mount portion 16 (refer to FIG. 3). The first hinge 40 extends in the direction crossing the transportation direction of the recording media P (that is, apparatus depth direction indicated with arrow Z). In the present exemplary embodiment, the first hinge 40 is disposed on the downstream side in the transportation direction of the recording media P (that is, in the direction of arrow A illustrated in FIG. 3). Both ends of the first hinge 40 in the longitudinal direction are supported by, for example, the front wall 12A and the rear wall 12B. In other words, the first hinge 40 is disposed at the edge of the upper wall 12D (refer to FIG. 2), or on first end portions of the front wall 12A and the rear wall 12B in the apparatus width direction.

While closing the mount space S, the open-close member 20 covers an area from the upper wall 12D up to the ends of the front wall 12A and the rear wall 12B on the upstream side in the transportation direction of the recording media P (that is, the direction of arrow A in FIG. 3). The open-close covering 30 covers a portion protruding from the front wall 12A and the rear wall 12B. The open-close member 20 includes an overhang 34, which protrudes from the edge of the open-close member 20, while the open-close member 20 closes the mount space S, to fill the gap between the edges of the cut portion 32 and the open-close member 20 (refer to FIG. 2).

The open-close member 20 is rotated upward to open the mount space S about the first hinge 40 from the closed position along the upper wall 12D. When the open-close member 20 opens the mount space S, in association with opening of the sheet feeder 10, the rotation member 22 overlapping the open-close member 20 rotates in such a direction as to stand erect. The sheet feeder 10 allows, while the open-close member 20 opens the mount space S, recording media P to be inserted across the front wall 12A and placed on the mount portion 16 (refer to FIG. 3). In the present exemplary embodiment, the front wall 12A has the cut portion 32. This structure facilitates placing of the recording media P on the mount portion 16 from the side near the front wall 12A.

As illustrated in FIGS. 4 to 7, the open-close member 20 has a recess 46 at an upper portion. The recess 46 is set back downward in the vertical direction at a center portion in the apparatus depth direction (that is, Z direction) (refer to FIG. 7). The open-close member 20 has a contact portion 48 at the upper portion. The contact portion 48 surrounds the recess 46 at a portion closer to the first hinge 40 and part of both sides of the recess 46 (refer to FIG. 7). A leading end portion 22A of the rotation member 22 comes into contact with the contact portion 48. The contact portion 48 has a stepwise slope inclined upward in a direction away from the first hinge 40. The contact portion 48 includes a first contact portion 48A disposed closer to the first hinge 40, and a second contact portion 48B disposed further from the first hinge 40 than the first contact portion 48A. An angle of the second contact portion 48B with respect to the horizontal direction is greater than an angle of the first contact portion 48A with respect to the horizontal direction. Here, the contact portion 48 is an example of an upper portion of the open-close member 20.

A handle 60 is disposed at a leading end portion 20A of the open-close member 20 opposite to an end portion closer to the first hinge 40. The handle 60 unlocks the open-close member 20 from the body 12 while the open-close member 20 opens the mount space S (refer to FIG. 3). In the present exemplary embodiment, the handle 60 is disposed at a portion of the open-close member 20 closer to the front wall 12A (closer to the front wall 12A with respect to the center portion) in the depth direction (that is, Z direction). For example, the handle 60 rotates vertically. When the handle 60 is raised upward, the open-close member 20 is unlocked from the body 12. Although not illustrated, the handle 60 is coupled to a hook disposed inside the open-close member 20. When the hook is locked on a rod disposed inside the body 12, the open-close member 20 is locked. When the handle 60 is raised upward, the hook is unlocked from the rod, so that the open-close member 20 is allowed to rotate.

Structure of Rotation Member 22

The rotation member 22 has a function of allowing manually inserted recording media (not illustrated) different from the recording media P to be placed. As illustrated in FIGS. 4 and 5, the rotation member 22 rotates about a second hinge 42 disposed closer to a first end than the first hinge 40 in the transportation direction of the recording media P (that is, the direction of arrow A illustrated in FIG. 3). The second hinge 42 is disposed parallel to the first hinge 40, and extends in the direction crossing the transportation direction of the recording media P (that is, crossing the direction of arrow A illustrated in FIG. 3). The second hinge 42 is disposed at a portion on the body 12 closer to the upper wall 12D (refer to FIG. 2) on the first end in the apparatus width direction than the first hinge 40. Both ends of the second hinge 42 in the longitudinal direction are supported by, for example, the front wall 12A and the rear wall 12B. In the present exemplary embodiment, the second hinge 42 is disposed downstream from the first hinge 40 in the transportation direction of the recording media P (that is, the direction of arrow A illustrated in FIG. 3).

The second hinge 42 is disposed at a higher position in the vertical direction of the sheet feeder 10 than (that is, upward in the vertical direction from) the first hinge 40. While the rotation member 22 is closed, at least part of the rotation member 22 overlaps the open-close member 20 that closes the mount space S. In this state, the leading end portion 22A of the rotation member 22 is in contact with the contact portion 48 of the open-close member 20.

The rotation member 22 is rotatable alone about the second hinge 42. The rotation member 22 shifts from the position overlapping the open-close member 20 to the erect position with an operation of the open-close member 20 opening the mount space S. Specifically, the rotation member 22 rotates in such a direction as to stand erect while sliding over the contact portion 48 of the open-close member 20 with the operation of the open-close member 20 opening the mount space S. In the sheet feeder 10, when the open-close member 20 is in the closing position, the rotation member 22 is allowed to rotate alone in such a direction as to stand erect, as described above. However, using the sheet feeder 10 while only the rotation member 22 stands erect has no practical meaning. Thus, usually, the open-close member 20 and the rotation member 22 are switched together into either the open position or the closing position.

In the sheet feeder 10, as illustrated in FIG. 5, when the open-close member 20 is in the maximum open state, the center of gravity G1 of the open-close member 20 is located closer to the second hinge 42 than to the first hinge 40.

In other words, when the open-close member 20 is in the maximum open state, the center of gravity G1 of the open-close member 20 is located between the first hinge 40 and the second hinge 42. When the rotation member 22 is in the open position (that is, in the erect state), the center of gravity G2 of the rotation member 22 is located between the first hinge 40 and the second hinge 42, so that the rotation member 22 is easily rotatable in the closing direction indicated with arrow C. In the sheet feeder 10, when the rotation member 22 is to rotate from the open position in the closing direction indicated with arrow C, the open-close member 20 is hindered from rotating in the closing direction due to the position of the center of gravity G of the open-close member 20.

As illustrated in FIGS. 4 to 7, a slide portion 52 is attached at each of frame portions 50 on both sides of the leading end portion 22A of the rotation member 22 in the apparatus depth direction (that is, Z direction). The slide portion 52 slides over the contact portion 48 of the open-close member 20 when the open-close member 20 is opened (refer to FIG. 7). The slide portion 52 is attached to a corner on the inner surface of the frame portion 50 of the rotation member 22. The slide portion 52 has a letter L shape in a front view, and includes a first attachment piece 52A and a second attachment piece 52B crossing the first attachment piece 52A. The first attachment piece 52A is attached to the inner surface of the frame portion 50 of the rotation member 22. The second attachment piece 52B is attached to the leading end surface of the frame portion 50 of the rotation member 22. The slide portion 52 is attached to the leading end surface and the inner surface of the rotation member 22 instead of the upper surface of the rotation member 22 not to be conspicuous.

The slide portion 52 is formed from, for example, a resin member softer than a resin member forming the contact portion 48 of the open-close member 20. Examples of the resin member forming the slide portion 52 include polyamide resin such as nylon and acrylonitrile butadiene styrene (ABS) resin (copolymerized synthetic resin including acrylonitrile, butadiene, and styrene). The body of the rotation member 22 is formed from, for example, a polycarbonate/acrylonitrile butadiene styrene (PC/ABS) resin (a blend of polycarbonate and a copolymerized synthetic resin including acrylonitrile, butadiene, and styrene). Examples of a resin member forming the contact portion 48 of the open-close member 20 include a PC/ABS resin. Instead of or in addition to the softness, the material forming the slide portion 52 may have further smoothness than a resin member forming other portion of the rotation member 22.

The rotation member 22 has a recess 54 at an upper portion and at a center portion in the apparatus depth direction (that is, Z direction). The recess 54 is set back downward in the vertical direction with respect to the frame portion 50 (refer to FIGS. 2 and 7). The recess 54 has an inclined surface that is inclined upward from the side closer to the upper wall 12D of the sheet feeder 10 toward the recess 46 of the open-close member 20 (that is, inclined upward in a direction away from the upper wall 12D). Manually inserted recording media (not illustrated) are placed in the recess 54 of the rotation member 22. A sheet feeding device (not illustrated) is disposed inside the upper wall 12D of the sheet feeder 10. The sheet feeding device feeds manually inserted recording media placed in the recess 54 of the rotation member 22 one by one.

As shown in FIG. 5, in the sheet feeder 10, when the open-close member 20 is in the maximum open position and the rotation member 22 is in the erect position, a height H1 from the upper surface of the rear wall 12B of the body 12 to the leading end surface of the leading end portion 20A of the open-close member 20 is, for example, approximately 358 mm. In the sheet feeder 10, a horizontal distance D between the first hinge 40 and the second hinge 42 in the apparatus width direction (that is, the direction of arrow X) is, for example, approximately 170 mm.

Structure of Damper 36

As described above, the damper 36 has a function of assisting the operation of the open-close member 20 opening the mount space S. As illustrated in FIGS. 3 to 6, the damper 36 is disposed between the rear wall 12B of the body 12 and the open-close member 20. A first end portion of the damper 36 is supported by the open-close member 20, and a second end portion of the damper 36 is supported by the rear wall 12B. More specifically, the damper 36 includes a hollow cylindrical damper body 36A and a rod 36B retractable with respect to the damper body 36A. An end portion of the damper body 36A opposite to an end portion closer to the rod 36B is supported by the open-close member 20 with an attachment 70. The leading end portion (that is, an end portion opposite to an end portion closer to the damper body 36A) of the rod 36B is supported by the rear wall 12B with an attachment 72. The attachment 70 supports the damper body 36A and the open-close member 20 while allowing them to rotate with respect to each other. The attachment 72 supports the rod 36B and the rear wall 12B while allowing them to rotate with respect to each other.

The present exemplary embodiment includes a single damper 36. Specifically, the damper 36 is disposed on a far side of the sheet feeder 10 in the depth direction (that is, Z direction). No damper is disposed on the near side, closer to the front wall 12A of the sheet feeder 10 in the depth direction (that is, Z direction).

In the damper 36, the rod 36B is pushed in the direction to move forward with respect to the damper body 36A. Specifically, the damper 36 exerts a maximum reaction force when having the shortest length in the longitudinal direction. In the present exemplary embodiment, when the open-close member 20 is raised midway in such a direction as to open the mount space S, the open-close member 20 is raised with the function of the damper 36.

Figure 8:
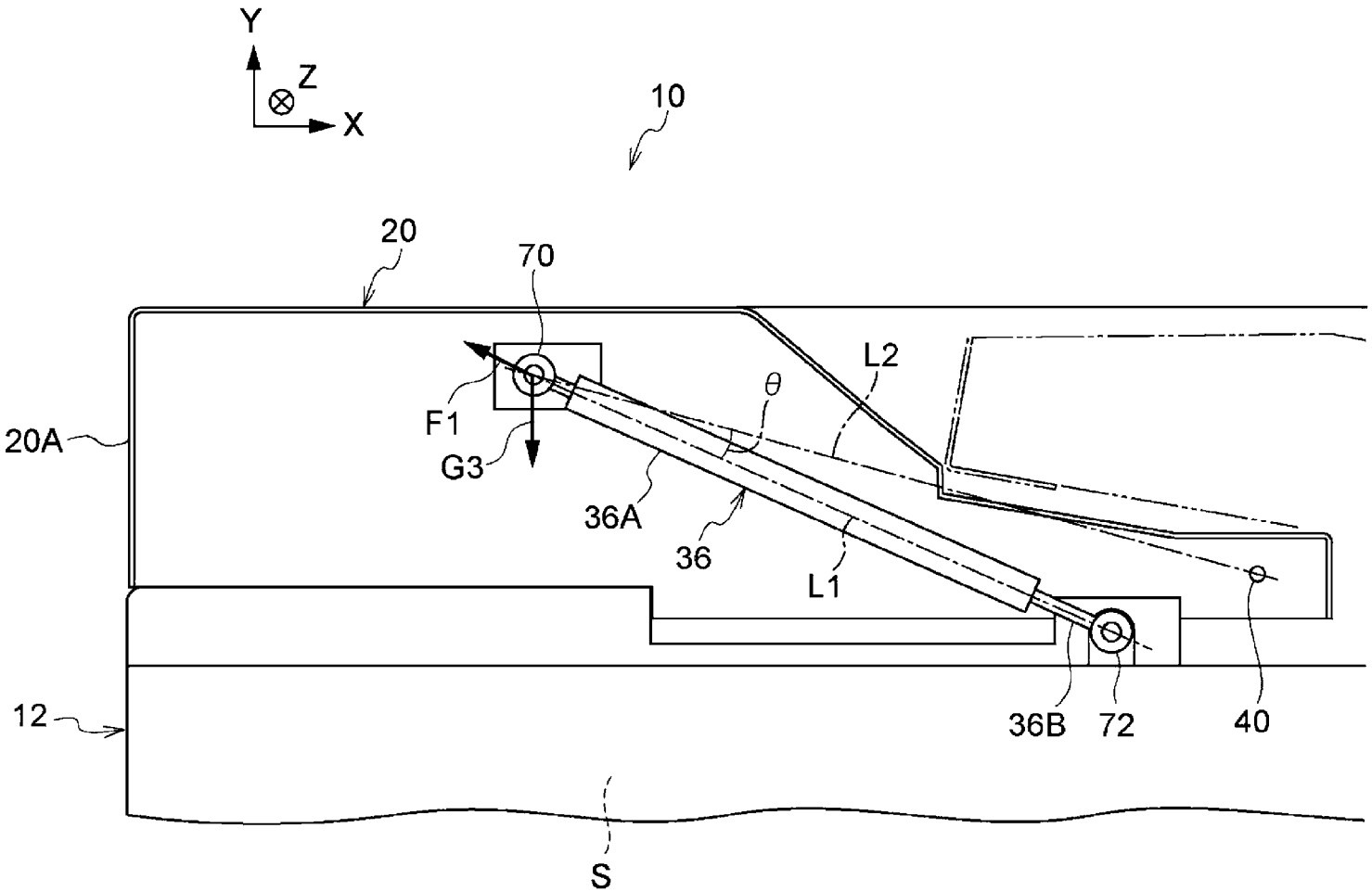
FIG. 8 is a front view of the upper portion of the sheet feeder according to the first exemplary embodiment, specifically the open-close member and a damper.

As illustrated in FIG. 8, an angle θ formed by a line L1 parallel to the axial direction of the damper 36 and a line L2 connecting the first hinge 40 and the rotation center of the attachment 70 that attaches the damper 36 to the open-close member 20 is set at, for example, 3°. The angle θ is preferably equal to or greater than 0° and equal to or smaller than 10°, more preferably, equal to or greater than 1° and equal to or smaller than 7°, and further preferably, equal to or greater than 2° and equal to or smaller than 4°.

In the present exemplary embodiment, when the open-close member 20 is closed, the center of gravity G3 is exerted on the attachment 70. In the present exemplary embodiment, the angle θ is set at 3°, and the reaction force (upward component F1 in FIG. 8) exerted from the damper 36 in the raising direction while the open-close member 20 is closed is approximate to 0. Specifically, in the sheet feeder 10, almost no force is exerted from the damper 36 in the raising direction while the open-close member 20 is closed. Thus, the open-close member 20 is less likely to be distorted (that is, distorted in the depth direction) when the open-close member 20 closes the mount space S.

Operations and Functions

Operations and functions of the present exemplary embodiment will be described.

In a normal state of the sheet feeder 10, the open-close member 20 is in the closing position to close the mount portion 16 on the upper surface of the body 12, and the open-close member 20 closes the mount space S over the mount portion 16 (refer to FIG. 2). In this state, part of the rotation member 22 is located to overlap the open-close member 20. When part of the rotation member 22 overlaps the open-close member 20, manually inserted recording media are placeable on the rotation member 22. When being rotated about the second hinge 42, the rotation member 22 rotates upward from the position overlapping the open-close member 20.

In the sheet feeder 10, to place the recording media P on the mount portion 16, the open-close member 20 is rotated about the first hinge 40 to open the mount space S over the mount portion 16 (refer to FIG. 3). With the operation of the open-close member 20 opening the mount space S, the rotation member 22 rotates about the second hinge 42 disposed parallel to the first hinge 40, and shifts from the position overlapping the open-close member 20 to the erect position.

Then, the open-close covering 30 of the container device 14 is rotated from the near side toward the far side in the apparatus depth direction to open the mount space S over the mount portion 16 (refer to FIG. 3). In this state, multiple recording media P are inserted across the front wall 12A of the body 12 to be placed on the mount portion 16.

Thereafter, the open-close member 20 is rotated to close the mount space S over the mount portion 16, and the rotation member 22 is rotated to the position overlapping the open-close member 20. In addition, the open-close covering 30 of the container device 14 is rotated to close the mount space S over the mount portion 16. In this state, the sheet feeder 10 is operated to transport the recording media P to the image forming apparatus body 202. The image forming apparatus body 202 forms images on the recording media P transported thereto.

In the sheet feeder 10, the open-close member 20 is opened and closed within a wider range than an open-close portion disposed to avoid a rotation member in a sheet feeder having an openable/closable upper surface and including a housing that includes a manual insertion portion which is served by the rotation member.

In the sheet feeder 10, the second hinge 42 is disposed closer to a first end of the body 12 in a first direction than the first hinge 40. For example, in the sheet feeder 10, when the open-close member 20 is in the maximum open position and the rotation member 22 is in the erect position, a height H1 from the upper surface of the rear wall 12B of the body 12 to the leading end surface of the leading end portion 20A of the open-close member 20 is, for example, approximately 358 mm. Thus, in the sheet feeder 10, when the open-close member 20 opens the mount space S, the height of the entire apparatus including the open-close member 20 and the rotation member 22 is prevented from being higher than the height of a structure including the first hinge located closer to the first end in the first direction of the housing than the second hinge.

In the sheet feeder 10, the rotation member 22 is shifted from the position where part of the rotation member 22 overlaps the open-close member 20 to the erect position with the operation of the open-close member 20 opening the mount space S. Thus, in the sheet feeder 10, the open-close member 20 performs the opening operation with less time and effort compared to the structure where the manual insertion portion does not stand erect with the operation of the open-close portion opening the mount space.

In the sheet feeder 10, the first hinge 40 extends in the direction crossing the transportation direction of the recording media P (that is, the direction of arrow A illustrated in FIG. 3) stacked on the mount portion S. Thus, the sheet feeder 10 facilitates removal and insertion of the recording medium P from and to the mount portion S compared to the structure where the first hinge extends in the transportation direction of recording media stacked on the mount portion.

To the body 12 of the sheet feeder 10, the container device 14 including the mount portion S that receives a recording medium P longer than an A3-size recording medium is removably attached. Thus, the sheet feeder 10 has a smaller size compared to a structure where a mount portion that receives long recording media is installed in advance in the housing.

In the sheet feeder 10, when the open-close member 20 is in the maximum open state, the center of gravity G1 of the open-close member 20 is located closer to the second hinge 42 than to the first hinge 40. Thus, when the rotation member 22 is to rotate from the open position in the closing direction indicated with arrow C, the open-close member 20 is hindered from rotating in the closing direction with the moment at the rotation center of the first hinge 40 of the open-close member 20 due to the center of gravity G1 of the open-close member 20. Specifically, even when the open-close member 20 is pushed by the rotation member 22, the open-close member 20 is less easily rotated in the closing direction opposite to the direction of the rotation with the center of gravity G1. Thus, in the sheet feeder 10, when the open-close portion is in the maximum open state, the open-close member 20 prevents the rotation member 22 from rotating in the falling direction compared to the structure where the center of gravity of the open-close portion is located closer to the first hinge than to the second hinge.

In the sheet feeder 10, with the operation of the open-close member 20 opening the mount space S, the rotation member 22 rotates in such a direction as to stand erect while sliding with the contact portion 48 at the upper portion of the open-close member 20. Thus, compared with a structure where the open-close portion and the manual insertion portion are interlocked with each other with a link mechanism, the rotation member 22 of the sheet feeder 10 is more easily rotatable with a simpler structure in association with the operation of the open-close member 20.

The slide portion 52 that slides over the contact portion 48 at the upper portion of the open-close member 20 is attached to the rotation member 22 of the sheet feeder 10. Thus, in the sheet feeder 10, the slide portion 52 on the rotation member 22 is more easily slidable over the contact portion 48 at the upper portion of the open-close member 20 compared to the structure where the manual insertion portion is in direct contact with the open-close portion.

In the sheet feeder 10, the slide portion 52 is formed from a resin member softer than the resin member forming the contact portion 48 at the upper portion of the open-close member 20. Thus, in the sheet feeder 10, the contact portion 48 at the upper portion of the open-close member 20 is less easily damaged than in a structure where the upper portions of the slide portion and the open-close portion are formed from the same material.

The sheet feeder 10 includes the front wall 12A and the rear wall 12B that hold the mount space S over the mount portion 16 therebetween from both sides in the direction crossing the transportation direction of the recording media P. The first hinge 40 and the second hinge 42 are supported by the front wall 12A and the rear wall 12B. The sheet feeder 10 allows recording media P to be inserted across the front wall 12A and placed on the mount portion 16. Thus, the sheet feeder 10 improves its workability when the recording media P are inserted across the front wall 12A to be placed on the mount portion 16, compared to the structure where recording media are inserted across the pair of walls to be placed on the mount portion.

The sheet feeder 10 includes the handle 60 at the leading end portion 20A of the open-close member 20 in the transportation direction of the recording media P opposite to an end portion closer to the first hinge 40. The handle 60 unlocks the open-close member 20 from the body 12 while the open-close member 20 opens the mount space S. Thus, the sheet feeder 10 has a simpler structure than a structure that unlocks the open-close portion at a portion closer to the first hinge in the transportation direction of the recording media.

In the sheet feeder 10, the handle 60 is disposed in the open-close member 20 at a portion closer to the front wall 12A. Thus, the sheet feeder 10 improves operability of the open-close member 20 opening the mount space S compared to the structure including a handle located at a portion of the open-close portion closer to the rear wall.

The sheet feeder 10 also includes the damper 36 between the rear wall 12B and the open-close member 20. The damper 36 assists the operation of the open-close member 20 opening the mount space S. Thus, the sheet feeder 10 improves operability of the open-close member 20 opening the mount space S compared to a structure not including a damper between another wall and the open-close portion.

The sheet feeder 10 includes a single damper 36. Specifically, no damper is installed between the front wall 12A and the open-close member 20. Thus, the sheet feeder 10 improves workability for placing the recording media P on the mount portion 16 from the side near the front wall 12A without interference of the damper 36 compared to a structure where a damper is disposed between the front wall and the open-close portion.

The image forming apparatus 200 includes the sheet feeder 10, and transports recording media P from the sheet feeder 10 to the image forming apparatus body 202. Thus, in the image forming apparatus 200, the open-close member 20 is opened and closed within a wider range compared to an open-close portion installed to avoid a manual insertion portion included in a housing in a sheet feeder having an openable/closeable upper surface.

Second Exemplary Embodiment

Figure 9:
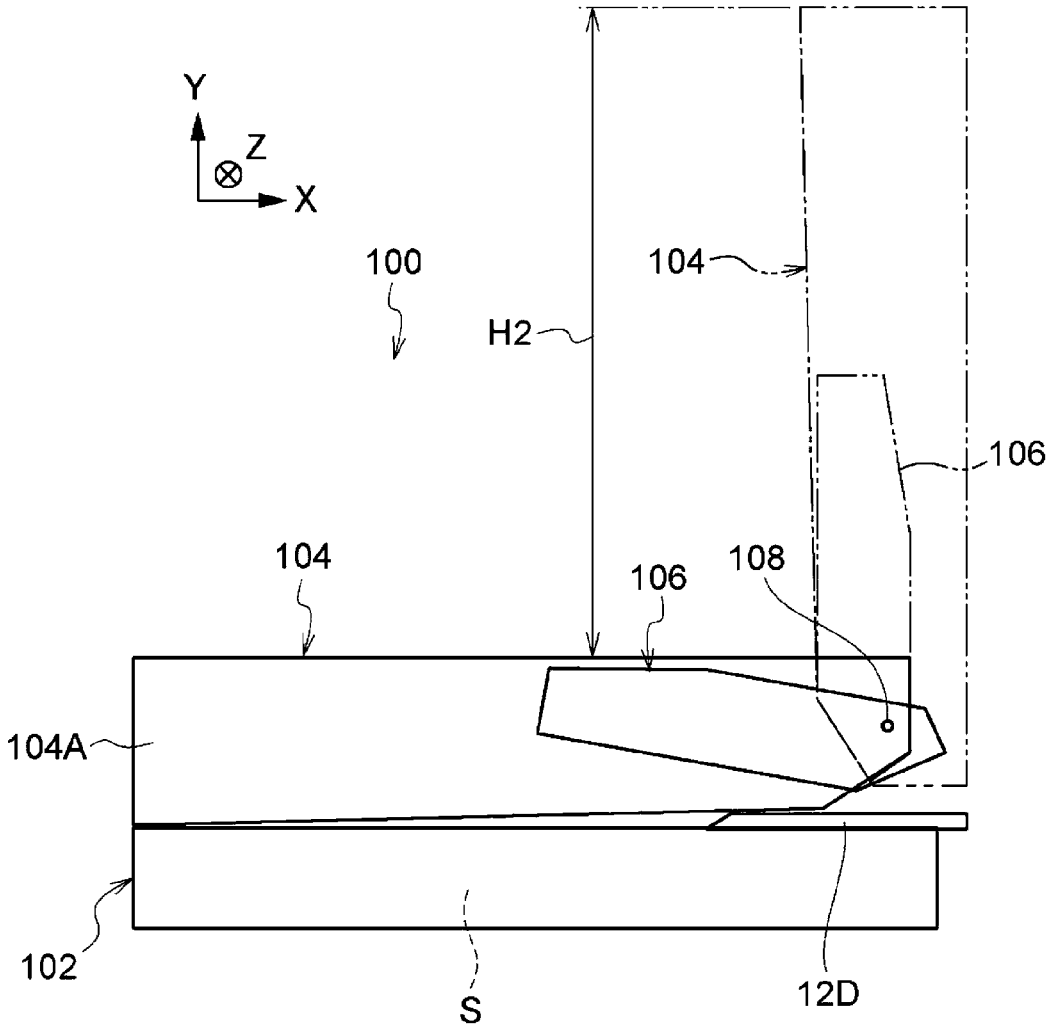
FIG. 9 is a front view of an upper portion of a sheet feeder according to a second exemplary embodiment where an open-close member and a rotation member are rotated to open a mount space over a mount portion.

With reference to FIG. 9, a sheet feeder 100 according to a second exemplary embodiment will be described now. Components the same as those of the first exemplary embodiment described above are denoted with the same reference signs without description.

As illustrated in FIG. 9, the sheet feeder 100 includes an open-close member 104 disposed at an upper portion of a body 102, and a rotation member 106 at least part of which is located to overlap the open-close member 104. The open-close member 104 rotates about a hinge 108 to close or open the mount space S over the mount portion. Here, the body 102 is an example of the housing, and the open-close member 104 is an example of the open-close portion. The hinge 108 is an example of the first hinge. The rotation member 106 is an example of the manual insertion portion.

The rotation member 106 is rotatable alone about the hinge 108 located at the same position as the open-close member 104 (that is, about the hinge 108 common to the hinge 108 about which the open-close member 104 rotates). When the rotation member 106 is located to overlap the open-close member 104, manually inserted recording media are placeable on the rotation member 106. The rotation member 106 shifts from the position overlapping the open-close member 104 to the erect position with the operation of the open-close member 104 opening the mount space S.

Although not illustrated, in the sheet feeder 100, the length of the mount portion in the apparatus width direction (that is, the direction of arrow X) is equal to the length of the mount portion 16 of the sheet feeder 10 according to the first exemplary embodiment (refer to FIG. 5) in the apparatus width direction (that is, the direction of arrow X). Thus, in the sheet feeder 100, the length of the open-close member 104 in the apparatus width direction (that is, the direction of arrow X) is longer than the length of the open-close member 20 of the sheet feeder 10 according to the first exemplary embodiment (refer to FIG. 5) in the apparatus width direction (that is, the direction of arrow X). For example, in the sheet feeder 100, when the open-close member 104 is in the maximum open position and the rotation member 106 is in the erect position, a height H2 from the upper surface of the body 102 to the leading end surface of a leading end portion 104A of the open-close member 104 is, for example, approximately 580 mm.

The sheet feeder 100 has the following operations and functions in addition to the operations and functions of the structure of the sheet feeder 10 according to the first exemplary embodiment.

In the sheet feeder 100, the rotation member 106 is rotatable about the hinge 108 common to the open-close member 104, and rotates upward from the position overlapping the open-close member 104. Thus, in the sheet feeder having an openable/closeable upper surface and including a housing that includes a manual insertion portion, the open-close member 104 is opened and closed within a wider range compared to an open-close portion disposed to avoid the manual insertion portion.

In the sheet feeder 100, the rotation member 106 is rotatable about the hinge 108 common to the open-close member 104. Thus, the sheet feeder 100 has a smaller size than a structure where the second hinge that rotates the manual insertion portion is located closer to a first end of the housing in a first direction than the first hinge that rotates the open-close portion.

In the sheet feeder 100, the open-close member 104 and the rotation member 106 are rotatable about the common hinge 108. However, the present disclosure is not limited to this structure. For example, the rotation member 106 may be rotatable about a second hinge located coaxial with the first hinge that rotates the open-close member 104 (located on an extension line of the first hinge that rotates the open-close member 104 in a side view).

Supplementary Explanation

In the first exemplary embodiment, the second hinge 42 is located at a higher position in the vertical direction of the sheet feeder 10 than the first hinge 40. However, the present disclosure is not limited to this structure. For example, the second hinge 42 and the first hinge 40 may be located at the same height or the second hinge 42 may be located at a lower height than the first hinge 40.

In the first exemplary embodiment, the shape of the contact portion 48 of the open-close member 20 is changeable, and the shape and the position of the slide portion 52 attached to the rotation member 22 are also changeable.

In the first exemplary embodiment, the handle 60 is located at a portion of the open-close member 20 closer to the front wall 12A in the apparatus depth direction. However, the present disclosure is not limited to this structure. The handle may be located around the center portion of the open-close member in the depth direction.

In the first and second exemplary embodiments, the position of the first hinge that rotates the open-close member and the position of the first hinge or the second hinge that rotates the rotation member are not limited to the above structure, and may be changed. For example, the first hinge that rotates the open-close member and the second hinge that rotates the rotation member may be arranged vertically at a first end portion of the body of the sheet feeder in the transportation direction of the recording media P. Here, the second hinge that rotates the rotation member is preferably disposed at a higher position than the first hinge that rotates the open-close member.

The present disclosure is described in detail using specific exemplary embodiments, but the present disclosure is not limited to these exemplary embodiments. It is apparent to practitioners skilled in the art that various other exemplary embodiments will be possible within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet feeder, comprising:

a housing including a mount portion that receives recording media;

an open-close portion that is disposed on an upper surface of the housing to close the mount portion and rotates about a first hinge to open or close a mount space over the mount portion; and a manual insertion portion at least part of which is disposed on the open-close portion to receive manually inserted recording media, the manual insertion portion being rotatable about the first hinge or a second hinge disposed parallel to the first hinge to rotate upward from a position where the manual insertion portion overlaps the open-close portion;

wherein a container member including the mount portion that receives recording media longer than an A3-size recording medium is removably attached to the housing.

2. The sheet feeder according to claim 1, wherein the second hinge is disposed at a portion of the housing closer to a first end in a first direction than the first hinge.

3. The sheet feeder according to claim 2, wherein the manual insertion portion shifts from a position where the manual insertion portion overlaps the open-close portion to an erect position with an operation of the open-close portion opening the mount space.

4. The sheet feeder according to claim 3, wherein the first hinge extends in a direction crossing a transportation direction of the recording media stacked on the mount portion.

5. The sheet feeder according to claim 3, wherein with the operation of the open-close portion opening the mount space, the manual insertion portion rotates in such a direction as to stand erect while sliding over an upper portion of the open-close portion.

6. The sheet feeder according to claim 5, wherein a slide portion that slides over the upper portion of the open-close portion is attached to the manual insertion portion.

7. The sheet feeder according to claim 6, wherein the slide portion is formed from a resin member softer than a resin member forming the upper portion of the open-close portion.

8. The sheet feeder according to claim 2, wherein the first hinge extends in a direction crossing a transportation direction of the recording media stacked on the mount portion.

9. The sheet feeder according to claim 2, wherein a container member including the mount portion that receives recording media longer than an A3-size recording medium is removably attached to the housing.

10. The sheet feeder according to claim 1, wherein the first hinge and the second hinge are disposed coaxial with each other or arranged vertically at a portion of the housing closer to a first end in a first direction.

11. The sheet feeder according to claim 10, wherein the first hinge extends in a direction crossing a transportation direction of the recording media stacked on the mount portion.

12. The sheet feeder according to claim 1, wherein the first hinge extends in a direction crossing a transportation direction of the recording media stacked on the mount portion.

13. The sheet feeder according to claim 12, further comprising:

a pair of walls that hold the mount space over the mount portion between themselves from both sides in a direction crossing a transportation direction of the recording media, wherein the first hinge or the second hinge is supported by the pair of walls, and wherein, while the open-close portion opens the mount space, the recording media are inserted across a first wall of the pair of walls to be placed on the mount portion.

14. The sheet feeder according to claim 13, further comprising:

a handle that is disposed at an end portion of the open-close portion opposite to an end portion closer to the first hinge in the transportation direction, and that unlocks the open-close portion from the housing including the pair of walls while the open-close portion closes the mount space.

15. The sheet feeder according to claim 14, wherein the handle is disposed at a portion of the open-close portion closer to the first wall.

16. The sheet feeder according to claim 13, further comprising:

a damper that is disposed between a second wall of the pair of walls and the open-close portion, and that assists an operation of the open-close portion opening the mount space.

17. The sheet feeder according to claim 16, wherein the damper is a single damper.

18. An image forming apparatus, comprising:

the sheet feeder according to claim 1, wherein the recording media are transported from the sheet feeder to an image forming unit.

19. A sheet feeder, comprising:

a housing including a mount portion that receives recording media;

an open-close portion that is disposed on an upper surface of the housing to close the mount portion and rotates about a first hinge to open or close a mount space over the mount portion; and a manual insertion portion at least part of which is disposed on the open-close portion to receive manually inserted recording media, the manual insertion portion being rotatable about the first hinge or a second hinge disposed parallel to the first hinge to rotate upward from a position where the manual insertion portion overlaps the open-close portion;

wherein the second hinge is disposed at a portion of the housing closer to a first end in a first direction than the first hinge;

wherein the manual insertion portion shifts from a position where the manual insertion portion overlaps the open-close portion to an erect position with an operation of the open-close portion opening the mount space;

wherein, when in a maximum open state, the open-close portion has a center of gravity at a position closer to the second hinge than to the first hinge.

20. The sheet feeder according to claim 19, wherein the first hinge and the second hinge are disposed coaxial with each other or arranged vertically at a portion of the housing closer to the first end in the first direction.

* * * * *